US006241021B1

(12) United States Patent
Bowling

(10) Patent No.: US 6,241,021 B1
(45) Date of Patent: Jun. 5, 2001

(54) METHODS OF COMPLETING AN UNCEMENTED WELLBORE JUNCTION

(75) Inventor: John S. Bowling, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/349,386

(22) Filed: Jul. 9, 1999

(51) Int. Cl.[7] ..... E03B 3/11
(52) U.S. Cl. ..... 166/380; 166/50
(58) Field of Search ..... 166/50, 117.6, 166/313, 380, 241.1

(56) References Cited

U.S. PATENT DOCUMENTS 5,477,925 * 12/1995 Trahan et al. ..... 166/382
5,526,880 * 6/1996 Jordan, Jr. et al. ..... 166/291
5,813,465 * 9/1998 Terrell et al. ..... 166/298

* cited by examiner

*Primary Examiner*—David Bagnell
*Assistant Examiner*—Jennifer R. Dougherty
(74) *Attorney, Agent, or Firm*—William M. Imwalle; Marlin R. Smith

(57) ABSTRACT

A method of completing an uncemented wellbore junction provides a well completion in which a tubular assembly is installed through a wellbore junction and then is left uncemented in the junction. Fluid communication is permitted between the interior of the assembly and a formation surrounding the junction after the completion. The method is especially useful in situations in which the formation surrounding the junction is relatively impermeable or is in a production zone, and the method additionally permits convenient access to a lower portion of a main wellbore for stimulation or abandonment purposes after the completion.

57 Claims, 5 Drawing Sheets

METHODS OF COMPLETING AN UNCEMENTED WELLBORE JUNCTION

BACKGROUND OF THE INVENTION

The present invention relates generally to subterranean well completions and, in an embodiment described herein, more particularly provides a method of completing an uncemented wellbore junction.

When a junction of intersecting wellbores is completed, it is generally considered desirable to isolate the formation surrounding the wellbore junction from one or more tubulars extending through the junction. This is due to the fact that fluids produced or injected through the tubulars should typically not be commingled with fluids from the formation surrounding the junction and/or should not be injected into the formation.

In order to isolate the formation surrounding the junction from the tubulars, various methods and apparatus have been developed. While being well suited for their intended purpose, they often require a large number of trips into the well, are time-consuming and, therefore, quite expensive in operation.

There exist situations in which it may not be necessary to isolate a tubular extending through a wellbore junction from a formation or zone surrounding the junction. For example, where the formation is relatively impermeable, it may be acceptable to permit fluid communication between the tubular and the formation. As another example, the formation may be a producing zone, in which case it may be desirable to permit fluid communication between the tubular and the formation in order to produce fluid from the formation through the tubular.

In those situations in which it is not necessary to isolate a tubular extending through a wellbore junction from a formation or zone surrounding the junction, the completion may be greatly simplified by eliminating procedures for providing such isolation, such as cementing the tubular within the junction. Additionally, such a simplified completion may also permit cost savings to be realized when the time comes to abandon the well.

SUMMARY OF THE INVENTION

In carrying out the principles of the present invention, in accordance with an embodiment thereof, a method is provided for completing an uncemented wellbore junction.

In broad terms, the method includes the steps of installing a tubular assembly through a wellbore junction and then sealingly engaging each opposite end of the assembly within a respective one of the intersecting wellbores. The sealing engagement of the assembly within the wellbores is accomplished without cementing the assembly within the junction. In this manner, fluid communication is permitted between the assembly and a formation surrounding the junction.

In one aspect of the invention, the tubular assembly is conveyed through a main wellbore and a lower end of the assembly is inserted into a branch wellbore intersecting the main wellbore while the upper end of the assembly remains in the main wellbore. The assembly, thus, extends across the main wellbore. In order to provide fluid communication between the main wellbore above and below the assembly, at least one opening is provided through a sidewall of the assembly.

In another aspect of the invention, a whipstock assembly may be utilized in drilling the branch wellbore and/or in deflecting the tubular assembly into the branch wellbore from the main wellbore. A fluid passage may be opened or formed through the whipstock assembly to facilitate fluid communication through the main wellbore. This may be accomplished before or after the tubular assembly is installed in the junction.

In yet another aspect of the invention, a fluid passage may be formed through the whipstock assembly at the same time one or more openings are provided through the assembly sidewall. For example, a perforating gun may be conveyed into the assembly and fired, thereby perforating the assembly and an upper closure plate of the whipstock at the same time. Alternatively, the whipstock assembly may be provided with a plug which is retrieved prior to installing the tubular assembly. As further alternatives, the whipstock may be provided with an inner core which is drilled through prior to installing the tubular assembly, which is dispersed prior to installing the tubular assembly, or which is dissolved after installing the tubular assembly.

In still another aspect of the invention, the tubular assembly may include a screen or a perforated liner. The screen or perforated liner may be positioned adjacent the wellbore junction when the tubular assembly is installed in the well. In this manner, fluid communication is provided through the assembly sidewall without requiring a separate operation to form openings therethrough.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
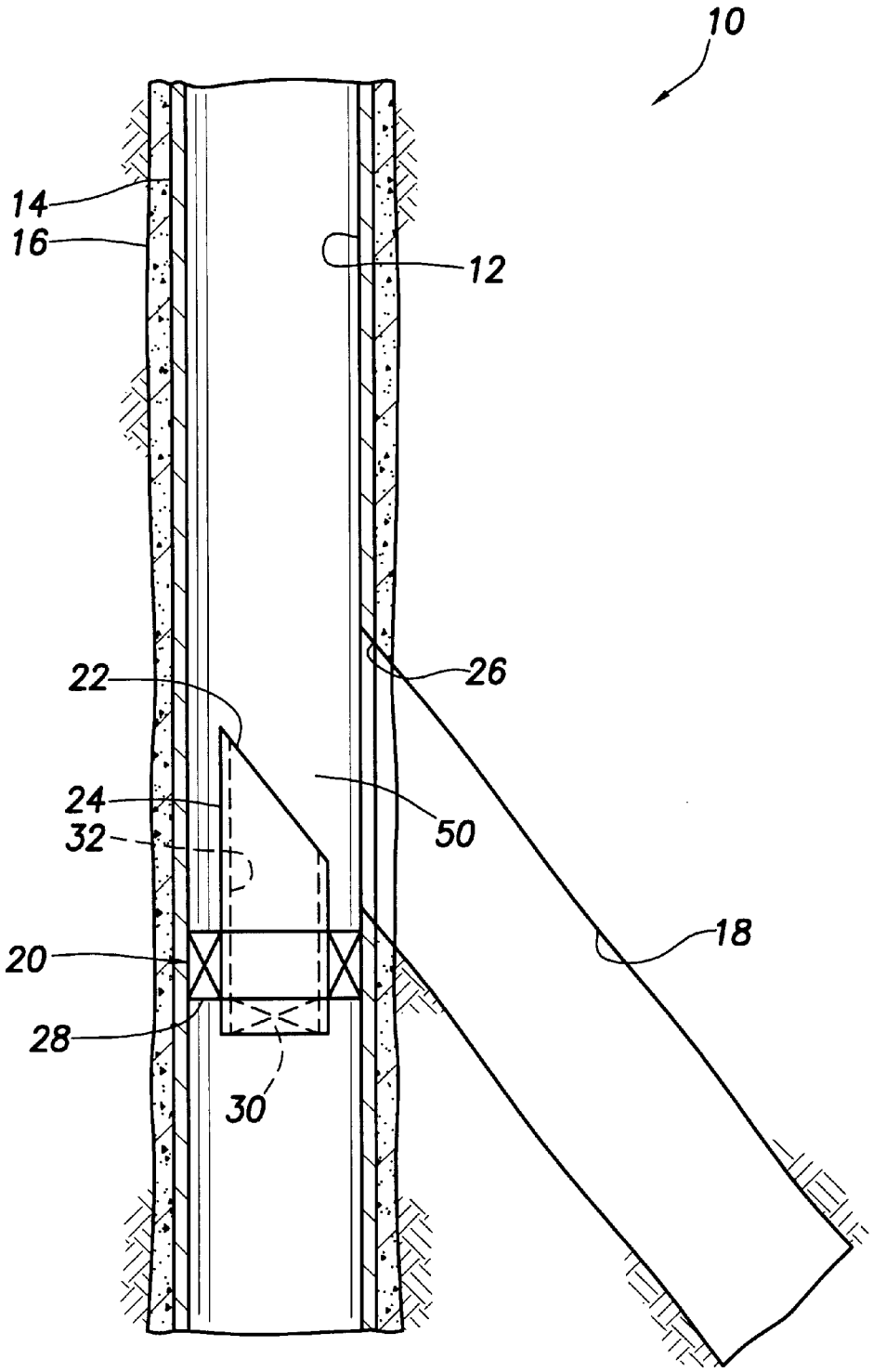
FIG. 1 is a schematic partially cross-sectional view of a well wherein initial steps in a first method embodying principles of the present invention have been performed.

Representatively and schematically illustrated in FIG. 1 is a method 10 of completing a subterranean well which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

As depicted in FIG. 1, initial steps of the method 10 have already been performed. A main or parent wellbore 12 has been drilled and lined with protective casing 14 and cement 16. Note that the reference number "12" indicates the inner diameter of the casing 14, since the wellbore is cased. If the wellbore 12 were uncased, the term "wellbore" would more properly refer to the uncased bore of the well. It is to be clearly understood that it is not necessary in the method 10, or any of the other methods and alternatives thereof described herein for any of the wellbores to be cased.

A branch or lateral wellbore 18 has been drilled extending outwardly from the main wellbore 12. Such drilling of the lateral wellbore 18 may be accomplished using any conventional practices. In the method 10 as representatively illustrated in FIG. 1, a whipstock assembly 20 has been positioned in the wellbore 12 with an upper inclined surface 22 of a whipstock 24 oriented toward a desired location for forming the branch wellbore 18. One or more cutting tools, such as mills, drill bits, etc. (not shown) have been deflected off of the surface 22 to form an opening or window 26 through the casing 14, and to drill the branch wellbore 18.

The whipstock assembly 20 as depicted in FIG. 1 includes the whipstock 24, a packer 28 and a plug 30. The packer 28 anchors the assembly 20 in the wellbore 12, seals against the casing 14 to prevent debris, etc. from accumulating during the milling and drilling operations described above, and provides fluid isolation. Note that other means may be used for anchoring the whipstock 24, without departing from the principles of the present invention. The plug 30 similarly provides fluid isolation since, in the representatively illustrated embodiment shown in FIG. 1, the whipstock 24 is hollow.

The main wellbore 12 below the whipstock assembly 20 may have been completed prior to installing the assembly in the well. The plug 30 and packer 28 prevent fluid communication with any completed zone therebelow for well control purposes, prevention of fluid loss, prevention of damage to any completed zone or zones, etc. However, after the branch wellbore 18 is drilled, the plug 30 may be retrieved from the whipstock assembly 20 to thereby open a flow passage 32 through the assembly.

Figure 2:
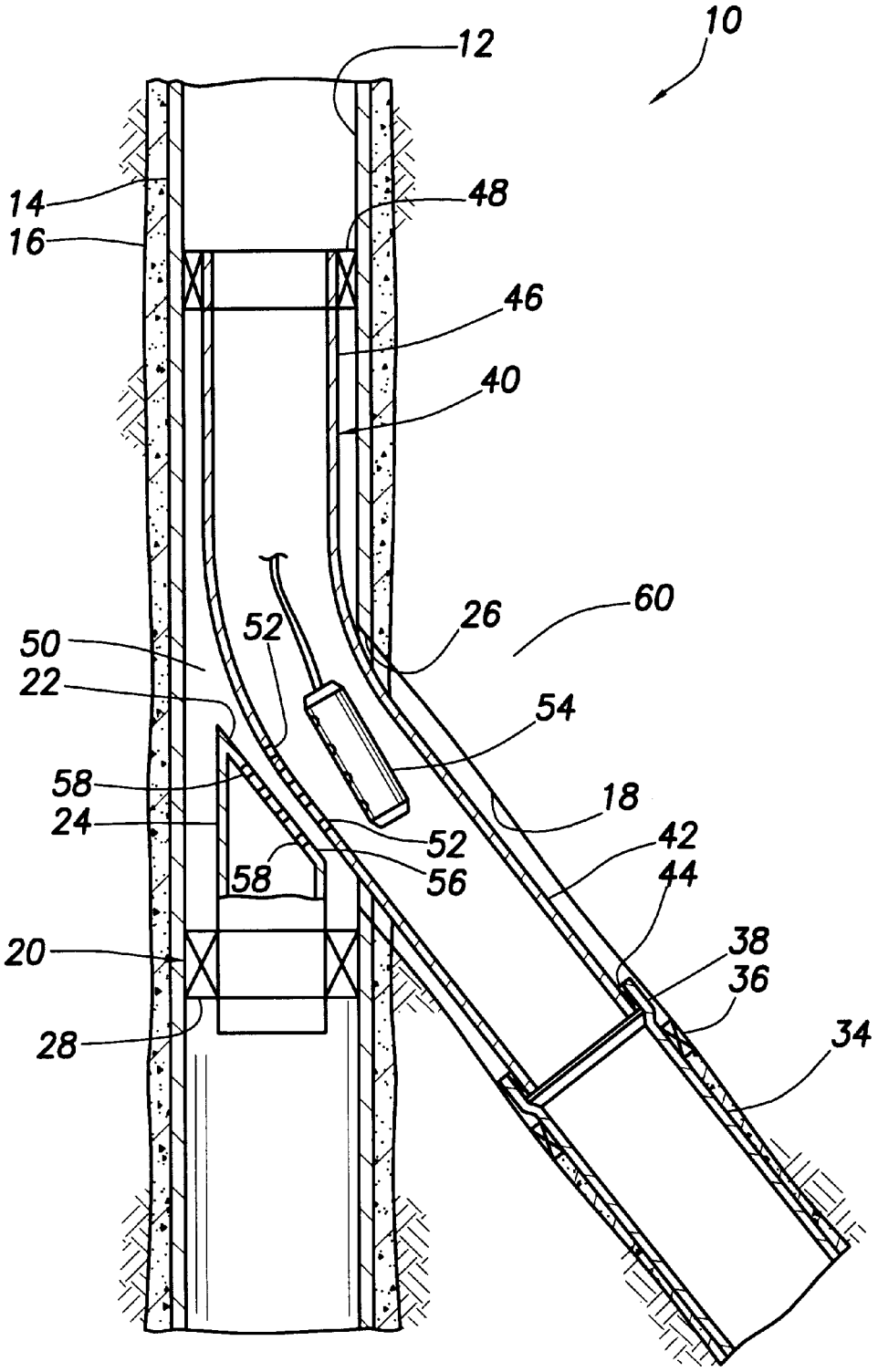
FIG. 2 is a schematic partially cross-sectional view of the well wherein further steps in the first method have been performed.

Referring additionally now to FIG. 2, further steps in the method 10 are representatively and schematically illustrated. A liner, casing or other tubular member 34 is installed in the branch wellbore 18 by conveying it through the main wellbore 12 and deflecting it off of the surface 22 and into the branch wellbore. The liner 34 is sealingly engaged with the wellbore 18 using an external casing packer or other sealing device 36. The liner 34 is then cemented within the wellbore 18.

An upper polished bore receptacle (PBR) 38 is attached to the liner 34 and packer 36 assembly. Another tubular assembly 40 is conveyed through the main wellbore 12 and a lower end 42 thereof inserted into the branch wellbore 18. The lower end 42 carries seals 44 externally thereon, which are sealingly engaged with the PBR 38. In this manner, the lower end 42 of the assembly 40 is sealingly engaged within the branch wellbore 18. An upper end 46 of the assembly 40 remains in the main wellbore 12 and is sealingly engaged therein by setting a packer or hanger 48 of the assembly in the main wellbore.

It may now be clearly seen that the tubular assembly 40 extends through a junction 50 of the intersecting wellbores 12, 18 and is sealingly engaged within each of the wellbores. Fluid from a formation or zone (not shown) intersected by the branch wellbore 18 may now be produced through the liner 34 and the tubular assembly 40. However, at this point fluid communication is not permitted between the interior of the tubular assembly 40 and the main wellbore 12 below the whipstock assembly 20.

To provide such fluid communication, one or more openings 52 may be formed through a sidewall of the assembly 40 adjacent the junction 50. For example, a perforating gun 54 may be conveyed into the assembly 40 and fired to form the openings 52. However, it is to be clearly understood that any other method for forming an opening through the assembly 40 may be utilized without departing from the principles of the present invention. For example, a chemical cutter, torch, mechanical piercing tool, etc. may be used to form the openings 52.

Note that the whipstock 24 as depicted in FIG. 2 has an alternate form compared to that shown in FIG. 1. The whipstock 24 shown in FIG. 2 has an upper closure plate 56 which initially prevents fluid communication through the whipstock. However, when the perforating gun 54, or other device, forms the openings 52 through the assembly 40, openings 58 are also formed through the closure plate 56, thereby providing a flow passage through the whipstock 24. In this manner, a separate trip to retrieve the plug 30 from the whipstock assembly 20 is not required, the plug not being used at all in the whipstock assembly as depicted in FIG. 2.

It will now be readily appreciated by one skilled in the art that fluid communication is now permitted between the main wellbore 12 above the assembly 40 and each of the branch wellbore 18 below the assembly 40 and the main wellbore 12 below the whipstock assembly 20 through the assembly 40. Fluid communication is also provided between the interior of the assembly 40 and a formation or zone 60 surrounding the junction 50. The formation 60 may be relatively impermeable, in which case little if any actual fluid flow is experienced between the formation 60 and the wellbores 12, 18, or fluid may be produced from, or injected into, the formation in the method 10 if desired. Note that no cement is deposited between the assembly 40 and the wellbores 12, 18 within the junction 50.

Figure 3:
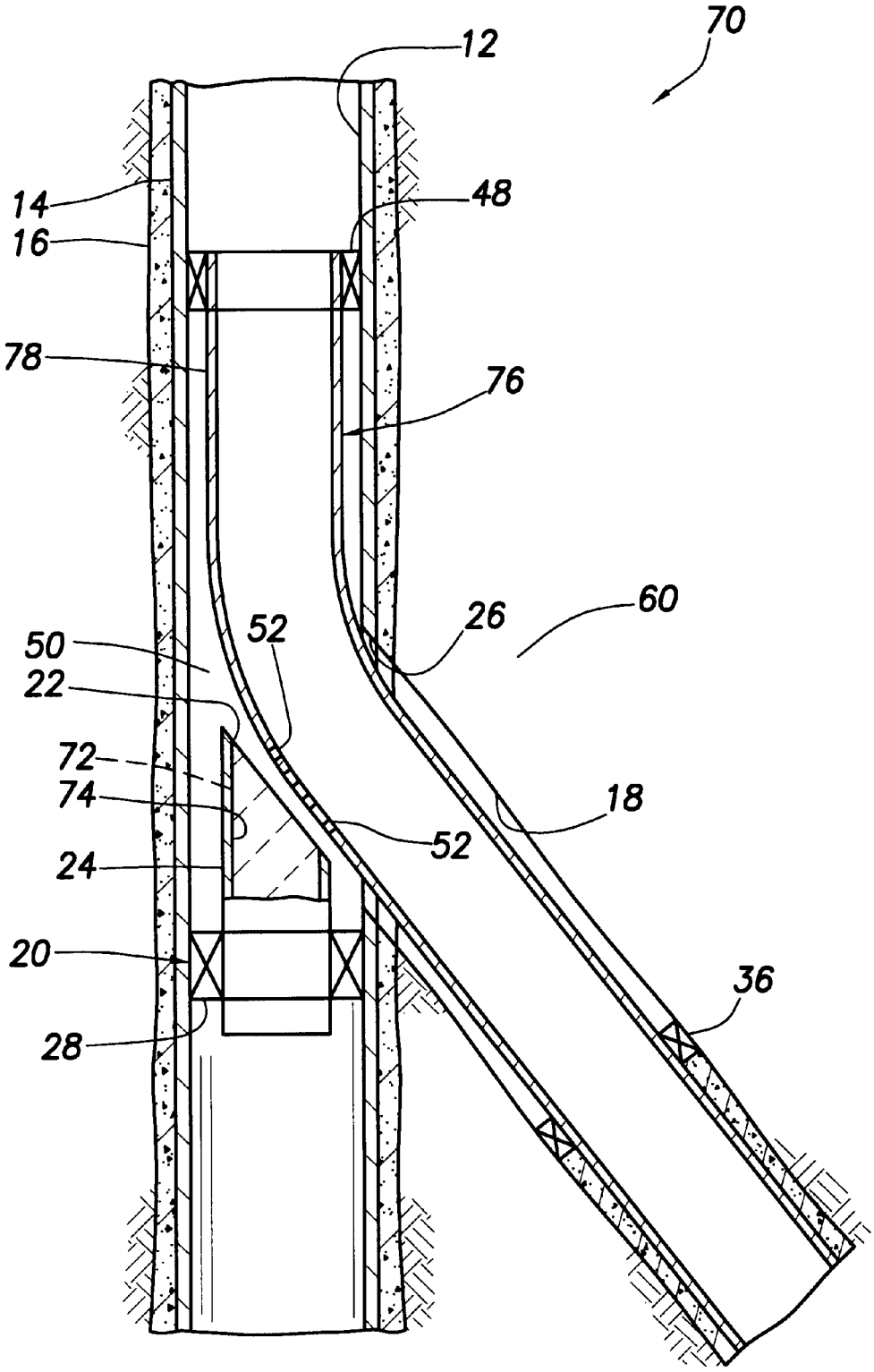
FIG. 3 is a schematic partially cross-sectional view of a second method embodying principles of the present invention.

Referring additionally now to FIG. 3, another method 70 of completing a subterranean well is representatively and schematically illustrated. The method 70 is similar in many respects to the method 10 described above and the same reference numbers are used to indicated elements similar to those described previously.

The method 70 differs in one respect from the method 10 in that the whipstock 24 has an alternate construction. The whipstock 24 as shown in FIG. 3 has a relatively easily drillable or millable inner core 72. The inner core 72 is relatively easily drillable as compared to the remainder of the whipstock 24 (i.e., the outer case thereof), for example, due to its being made of a softer material. The inner core 72 does, however, prevent fluid communication through a flow passage 74 of the whipstock 24, until the inner core is drilled through.

The inner core 72 is shown in dashed lines to indicate that it has already been drilled through as the method 70 is depicted in FIG. 3. Thus, the inner core 72 is drilled through prior to installing a tubular assembly 76 in the wellbores 12, 18. Note that, when the tubular assembly 76 is installed, it is conveyed through the main wellbore 12 and deflected into the branch wellbore 18 off of the surface 22, even though the inner core 72 is drilled through.

Alternatively, the inner core 72 could be drilled through after the tubular assembly 76 is installed in the wellbores 12, 18 by drilling or milling through a sidewall of the assembly and continuing to cut through the inner core. However, as depicted in FIG. 3, openings 52 have been formed through the assembly 76 as described above for the method 10, i.e., by use of a perforating gun, torch, chemical cutter, etc.

The method 70 differs from the method 10 in another respect in that the assembly 76 may be installed in one trip into the well, instead of two trips to install the liner 34 and assembly 40 as described above. The assembly 76 is sealingly engaged within the wellbore 18 using the external casing packer or other sealing device 36. The assembly 76 is then cemented within the wellbore 18 below the packer 36. An upper end 78 of the assembly 76 remains in the main wellbore 12 and is sealingly engaged therein by setting the packer or hanger 48 of the assembly in the main wellbore. It is to be clearly understood, however, that it is not necessary in a method incorporating principles of the present invention for the packer 36 to be included in the assembly 76 or for the assembly to be cemented within the wellbore 18.

It may now be clearly seen that the tubular assembly 76 extends through the junction 50 of the intersecting wellbores 12, 18 and is sealingly engaged within each of the wellbores. Fluid from a formation or zone (not shown) intersected by the branch wellbore 18 may now be produced through the tubular assembly 76. Fluid communication is also permitted between the interior of the tubular assembly 76 and the main wellbore 12 below the whipstock assembly 20, and between the interior of the tubular assembly 76 and the formation 60 surrounding the junction 50.

Note that the whipstock 24 as depicted in FIG. 3 does not necessarily include the inner core 72, but could alternatively be configured as shown in FIG. 1 or FIG. 2. Thus it is not necessary in the method 70 for the whipstock assembly 20 to be configured as shown in FIG. 3. Other whipstocks, including alternate whipstocks described herein, and other types of deflection devices may be utilized, without departing from the principles of the present invention.

It will now be readily appreciated by one skilled in the art that fluid communication is now permitted between the main wellbore 12 above the assembly 76 and each of the branch wellbore 18 below the assembly 76 and the main wellbore 12 below the whipstock assembly 20 through the assembly 76. Fluid communication is also provided between the interior of the assembly 76 and the formation or zone 60 surrounding the junction 50. The formation 60 may be relatively impermeable, in which case little if any actual fluid flow is experienced between the formation 60 and the wellbores 12, 18, or fluid may be produced from, or injected into, the formation in the method 70 if desired. Note that no cement is deposited between the assembly 76 and the wellbores 12, 18 within the junction 50.

Figure 4:
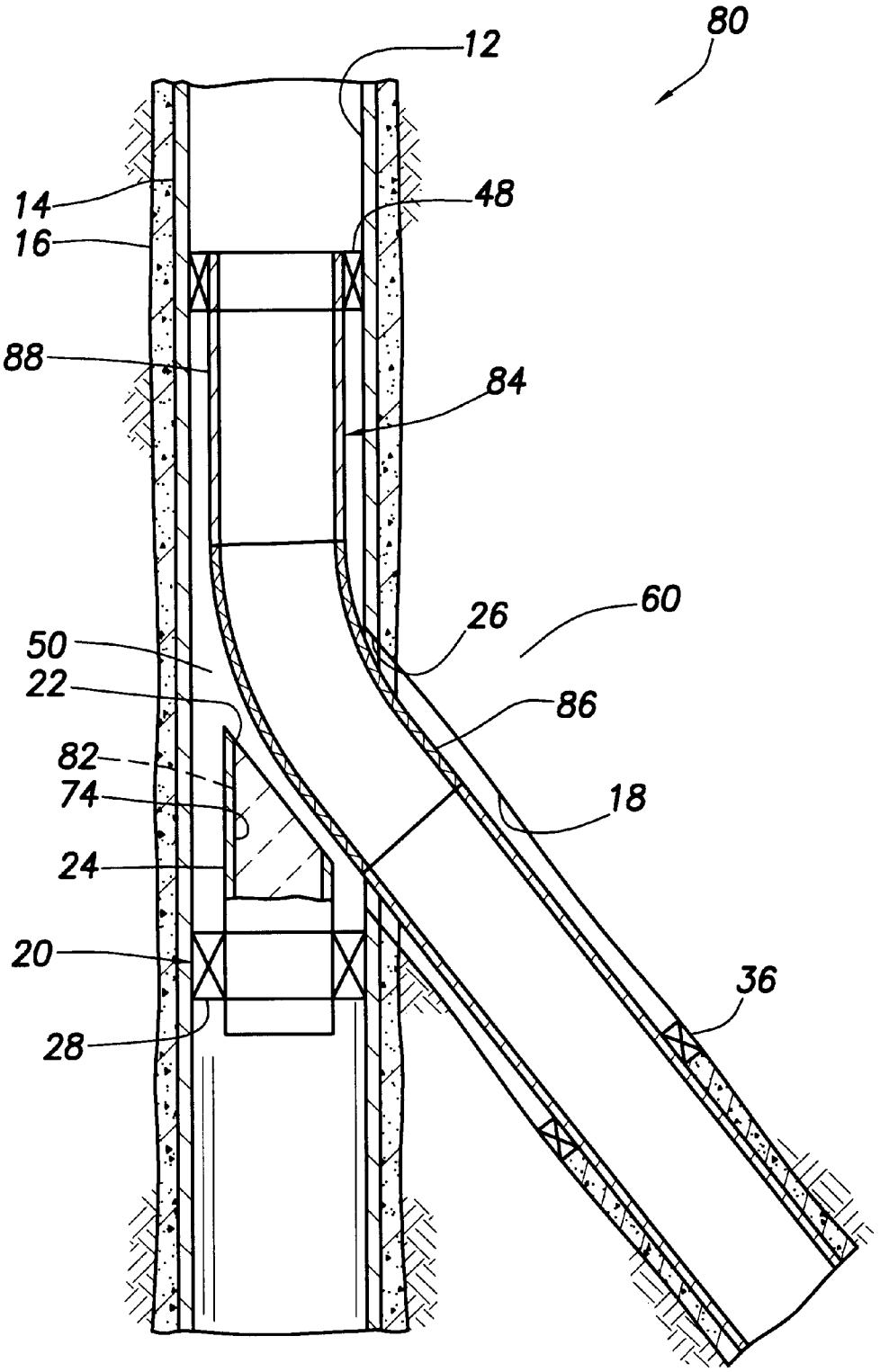
FIG. 4 is a schematic partially cross-sectional view of a third method embodying principles of the present invention.

Referring additionally now to FIG. 4, another method 80 of completing a subterranean well is representatively and schematically illustrated. The method 80 is similar in many respects to the methods 10, 70 described above and the same reference numbers are used to indicated elements similar to those described previously.

The method 80 differs in one respect from the methods 10, 70 in that the whipstock 24 has an alternate construction. The whipstock 24 as shown in FIG. 4 has a selectively dissolvable inner core 82. The inner core 82 is selectively dissolvable in that a particular type of fluid will dissolve the inner core when brought into contact with the inner core. For example, the inner core 82 may be readily dissolvable by acid. The inner core 82 does, however, prevent fluid communication through the flow passage 74 of the whipstock 24, until the inner core is dissolved.

The inner core 82 is shown in dashed lines to indicate that it has already been dissolved as the method 80 is depicted in FIG. 4. The inner core 82 may be dissolved prior to, during, or after installing a tubular assembly 84 in the wellbores 12, 18. Note that, when the tubular assembly 84 is installed, it is conveyed through the main wellbore 12 and deflected into the branch wellbore 18 off of the surface 22, even though the inner core 82 may have already been dissolved at the time.

The inner core 82 may be dissolved before installing the assembly 84 by, for example, circulating a fluid, such as acid, through a tubing string, such as a coiled tubing string, positioned adjacent the inner core. The inner core 82 may be dissolved during installation of the assembly 84 by, for example circulating the fluid through the assembly 84 as it is positioned adjacent the inner core. The inner core may be dissolved after installation of the assembly 84 by, for example, circulating the fluid through a screen or perforated liner 86 interconnected in the assembly. Note that, when the assembly 84 is properly installed in the wellbores 12, 18, the screen 86 is preferably, but not necessarily, positioned within or adjacent the junction 50 as shown in FIG. 4.

The method 80 differs from the method 10 in another respect in that the assembly 84 may be installed in one trip into the well, instead of two trips to install the liner 34 and assembly 40 as described above. The assembly 84 is sealingly engaged within the wellbore 18 using the external casing packer or other sealing device 36. The assembly 84 is then cemented within the wellbore 18 below the packer 36. An upper end 88 of the assembly 84 remains in the main wellbore 12 and is sealingly engaged therein by setting the packer or hanger 48 of the assembly in the main wellbore. It is to be clearly understood, however, that it is not necessary in a method incorporating principles of the present invention for the packer 36 to be included in the assembly 84 or for the assembly to be cemented within the wellbore 18.

It may now be clearly seen that the tubular assembly 84 extends through the junction 50 of the intersecting wellbores 12, 18 and is sealingly engaged within each of the wellbores. Fluid from a formation or zone (not shown) intersected by the branch wellbore 18 may now be produced through the tubular assembly 84. Fluid communication is also permitted between the interior of the tubular assembly 84 and the main wellbore 12 below the whipstock assembly 20, and between the interior of the tubular assembly 84 and the formation 60 surrounding the junction 50.

Note that the whipstock 24 as depicted in FIG. 4 does not necessarily include the inner core 82, but could alternatively be configured as shown in FIG. 1, FIG. 2 or FIG. 3. Thus it is not necessary in the method 80 for the whipstock assembly 20 to be configured as shown in FIG. 4. Other whipstocks, including alternate whipstocks described herein, and other types of deflection devices may be utilized, without departing from the principles of the present invention.

It will be readily appreciated by one skilled in the art that fluid communication is now permitted between the main wellbore 12 above the assembly 84 and each of the branch wellbore 18 below the assembly 84 and the main wellbore 12 below the whipstock assembly 20 through the assembly 84. Fluid communication is also provided between the interior of the assembly 84 and the formation or zone 60 surrounding the junction 50. The formation 60 may be relatively impermeable, in which case little if any actual fluid flow is experienced between the formation 60 and the wellbores 12, 18, or fluid may be produced from, or injected into, the formation in the method 80 if desired. Note that no cement is deposited between the assembly 84 and the wellbores 12, 18 within the junction 50.

It will also be readily appreciated that the above methods 10, 70, 80 facilitate convenient abandonment of the well. For example, the tubular assembly 40, 76 or 84 is not cemented within the junction 50 and is, therefore, much easier to retrieve from the well than if it were cemented therein. To abandon the well in the method 10, abandonment operations may be performed in the branch wellbore 18, then the assembly 40 may be cut below the window 26 using conventional techniques, or the assembly 40 may be disengaged from the PBR 38. The packer 48 may then be released and the assembly 40 retrieved from the well.

The whipstock 24 may be retrieved, if desired for abandonment of the lower main wellbore 12, using a conventional overshot. The remainder of the whipstock assembly 20 may be retrieved by disengaging the packer 28 from the wellbore 12. Note that, if the whipstock is hollow, such as the whipstock 24 shown in FIGS. 1, 3 & 4, and the whipstock 90 shown in FIG. 6, it may not be necessary to retrieve the whipstock. Note, also, that these retrieval operations may be performed if desired prior to stimulating the well below the whipstock assembly 20.

Figure 5:
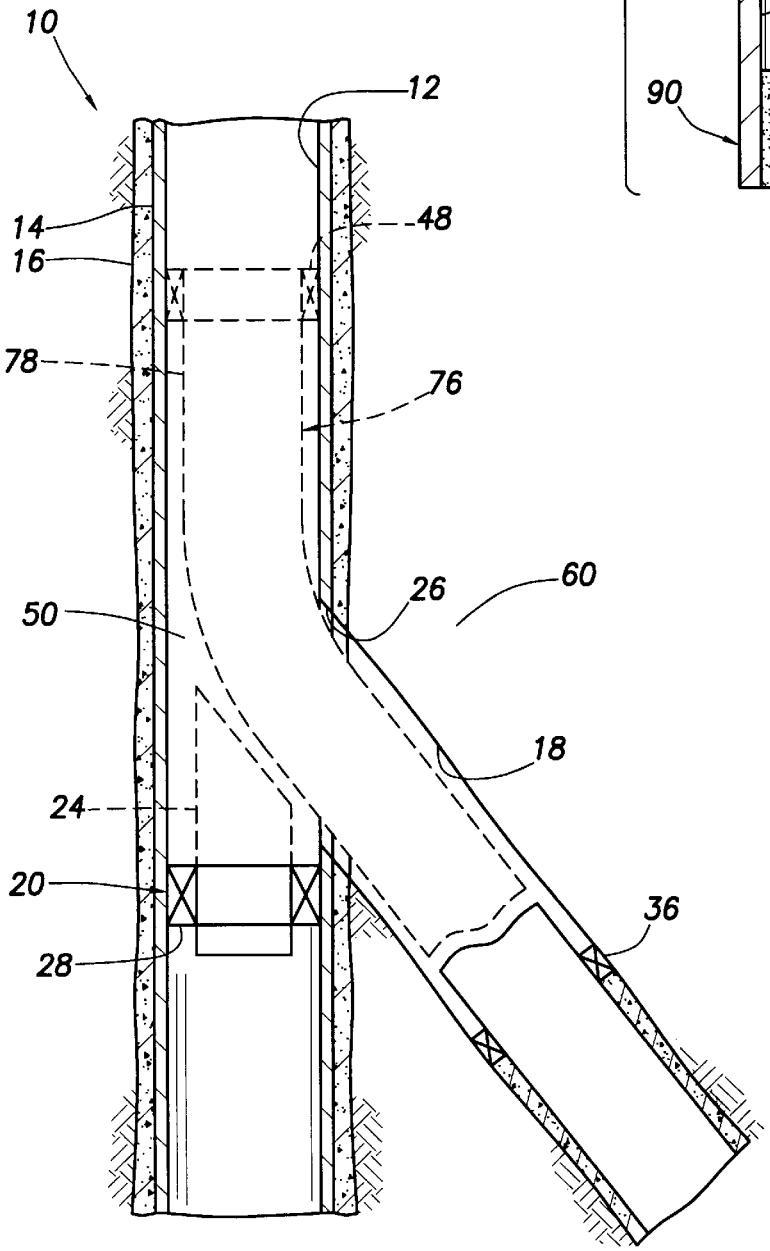
FIG. 5 is a schematic partially cross-sectional view of the well wherein further steps in the first method have been performed.

Referring additionally now to FIG. 5, the method 10 is depicted in somewhat alternate form, utilizing the tubular assembly 76 instead of the tubular assembly 40. To facilitate abandonment of the well or stimulation operations, access to the main wellbore 12 on each side of the junction 50 is desired. To accomplish this result, the tubular assembly 76 is severed within the branch wellbore 18, the packer 48 is unset and the upper end 78 of the tubular assembly is retrieved from the well. If the well is to be abandoned, preferably suitable abandonment operations are performed in the branch wellbore 18 prior to severing the tubular assembly 76 and retrieving the upper end 78 of the tubular assembly from the well. The tubular assembly 76 may be severed by any known method, such as, by chemical cutter, mechanical cutter, explosive cutter, etc. Additionally, if the tubular assembly 40 is used in the method in place of the tubular assembly 76, the lower end 42 and seals 44 thereof may be disengaged from the PBR 38, with no need to cut the tubular assembly 40. A portion of the tubular assembly 76 is shown in FIG. 5 in dashed lines to indicate that it has been retrieved from the well.

If the whipstock 24 is provided with a flow passage therethrough, as described above, it may not be necessary to retrieve the whipstock in order to perform abandonment or stimulation operations in the main wellbore 12 below the whipstock. However, if it is desired to retrieve the whipstock 24, an overshot may be used as described above, or another type of retrieval tool may be used to disengage the whipstock from the packer 28. Alternatively, the whipstock 24 and packer 28 could be retrieved together from the well by unsetting the packer. The whipstock 24 is shown in dashed lines in FIG. 5 to indicate that it has been retrieved from the well.

It will be readily appreciated that, with the upper portion of the tubular assembly 76 and the whipstock 24 retrieved from the well, access is now provided to the main wellbore 12 below the junction 50 for stimulation or abandonment operations therein. Note that the whipstock 24 and the upper portion of the tubular assembly 76 may be reinstalled in the well if desired. If the tubular assembly 40 is used in the method 10, then reinstallation of the tubular assembly is made more convenient due to the presence of the PBR 38 in the branch wellbore 18.

Figure 6:
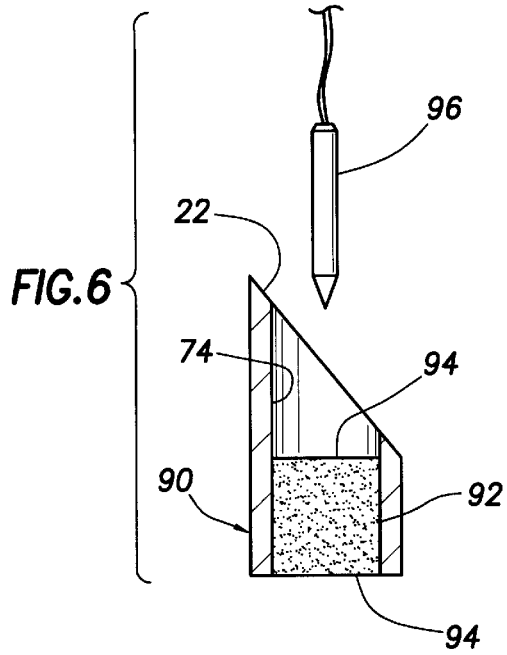
FIG. 6 is a schematic partially cross-sectional view of a whipstock which may be used in the methods of FIGS. 1–5, and a method of providing a flow passage therethrough.

Referring additionally now to FIG. 6, an alternate whipstock 90 embodying principles of the present invention is representatively and schematically illustrated. The whipstock 90 may be used in place of the whipstock 24 in any of the methods 10, 70, 80 described above.

The whipstock 90 has a plug 92 positioned in the flow passage 74 blocking fluid flow therethrough. The plug 92 is preferably dispersible upon contact with fluid in the well. For example, the plug 92 may be made of a compressed salt and sand mixture which is capable of resisting a pressure differential applied thereacross, but which is structurally compromised when placed in contact with fluid in the well. An example of such a dispersible plug structure is provided in U.S. Pat. No. 5,479,986, the disclosure of which is incorporated herein by this reference. However, it is to be clearly understood that other dispersible plug structures may be used in the whipstock 90 without departing from the principles of the present invention.

Barrier members 94 isolate the plug 92 from fluid in the well. The barrier members 94 may be made of an elastomeric material, ceramic material, or other type of material. To expose the plug 92 to the fluid in the well, at least one of the barrier members 94 may be pierced or broken, for example, by impacting it with a wireline or slickline conveyed piercing tool 96. However, many other ways of exposing the plug 92 to fluid in the well may be utilized as well. For example, a port or a fluid conduit may be opened to permit fluid communication with the plug, etc. Thus, it will be readily appreciated that any manner of providing contact between the plug 92 and fluid in the well may be used, without departing from the principles of the present invention.

Of course, a person skilled in the art would, upon consideration of the foregoing detailed description readily appreciate that many additions, substitutions, deletions and other changes may be made to the specific embodiments described above, and these changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of completing a subterranean well, the method comprising the steps of:

installing a tubular assembly through a wellbore junction of the well at which first and second wellbores intersect, a first opposite end of the assembly extending within the first wellbore, and a second opposite end of the assembly extending within the second wellbore;

sealingly engaging each of the first and second opposite ends of the assembly with respective ones of the first and second wellbores, without cementing the assembly within the junction; and permitting fluid communication between the interior of the tubular assembly and a formation surrounding the wellbore junction while the first and second opposite ends of the tubular assembly are respectively and sealingly engaged within the first and second wellbores.

2. The method according to claim 1, wherein the sealingly engaging step further comprises engaging the second opposite end with a polished bore receptacle within the second wellbore.

3. The method according to claim 2, further comprising the step of installing the polished bore receptacle in the second wellbore attached to a tubular member.

4. The method according to claim 3, further comprising the step of cementing the tubular member within the second wellbore.

5. The method according to claim 1, further comprising the step of forming at least one opening through the tubular assembly proximate the wellbore junction.

6. The method according to claim 5, wherein the forming step is performed by perforating the assembly after the installing step.

7. The method according to claim 5, wherein the forming step further comprises forming a fluid passage through a whipstock.

8. The method according to claim 7, wherein the step of forming the fluid passage through the whipstock further comprises piercing an upper closure plate of the whipstock.

9. The method according to claim 1, wherein the sealingly engaging step further comprises setting a packer attached to the assembly in the second wellbore.

10. The method according to claim 1, wherein the sealingly engaging step further comprises cementing the assembly within the second wellbore.

11. The method according to claim 1, further comprising the step of providing a fluid passage through a whipstock positioned in the first wellbore adjacent the wellbore junction.

12. The method according to claim 11, wherein the providing step comprises cutting through an inner core of the whipstock.

13. The method according to claim 12, wherein the cutting step is performed prior to the installing step.

14. The method according to claim 11, wherein the providing step is performed by dissolving an inner core of the whipstock.

15. The method according to claim 14, wherein the dissolving step is performed prior to the installing step.

16. The method according to claim 14, wherein the dissolving step is performed after the installing step.

17. The method according to claim 14, wherein the dissolving step is performed by circulating a fluid through the assembly.

18. The method according to claim 14, wherein the dissolving step is performed by contacting the inner core with an acidic fluid.

19. The method according to claim 1, further comprising the step of opening a fluid passage through a whipstock positioned adjacent the wellbore junction.

20. The method according to claim 19, wherein the opening step is performed by retrieving a plug blocking fluid flow through the passage.

21. The method according to claim 19, wherein the opening step is performed by dispersing a plug structure blocking fluid flow through the passage.

22. The method according to claim 21, wherein the dispersing step is performed by providing contact between the plug structure and fluid in the well.

23. The method according to claim 22, wherein the providing step is performed by piercing a barrier member isolating the plug structure from contact with the fluid.

24. The method according to claim 21, further comprising the step of constructing the plug structure of a mixture of sand and salt.

25. The method according to claim 1, wherein the installing step further comprises positioning a screen portion of the assembly within the wellbore junction.

26. The method according to claim 25, further comprising the step of dissolving an inner core of a whipstock positioned adjacent the wellbore junction by circulating a fluid through the screen portion.

27. A method of completing a subterranean well, the method comprising the steps of:

sealingly engaging first and second opposite ends of a tubular assembly within respective ones of first and second wellbores intersecting at a wellbore junction of the well; and permitting fluid communication between the interior of the tubular assembly and a formation surrounding the wellbore junction while the first and second opposite ends of the tubular assembly are respectively and sealingly engaged within the first and second wellbores.

28. The method according to claim 27, wherein the permitting step is performed by providing at least one opening through the assembly proximate the wellbore junction.

29. The method according to claim 27, wherein the permitting step is performed by providing an absence of cement between the assembly and each of the first and second wellbores in the wellbore junction.

30. The method according to claim 27, wherein the sealingly engaging step further comprises engaging the second opposite end with a polished bore receptacle within the second wellbore.

31. The method according to claim 30, further comprising the step of providing access to the first wellbore on each side of the wellbore junction by releasing an anchoring device releasably securing the first opposite end of the tubular assembly in the first wellbore, and disengaging the tubular assembly from the polished bore receptacle.

32. The method according to claim 30, further comprising the step of installing the polished bore receptacle in the second wellbore attached to a tubular member.

33. The method according to claim 32, further comprising the step of cementing the tubular member within the second wellbore.

34. The method according to claim 27, wherein the permitting step further comprises forming at least one opening through the tubular assembly proximate the wellbore junction.

35. The method according to claim 34, wherein the forming step is performed by perforating the assembly after the sealingly engaging step.

36. The method according to claim 34, wherein the forming step further comprises forming a fluid passage through a whipstock.

37. The method according to claim 36, wherein the step of forming the fluid passage through the whipstock further comprises piercing an upper closure plate of the whipstock.

38. The method according to claim 37, further comprising the step of providing access to the first wellbore on each side of the wellbore junction by retrieving from the first wellbore at least a portion of the tubular assembly extending across the first wellbore, releasing the whipstock from an anchoring device anchoring the whipstock in the first wellbore, and retrieving the whipstock from the first wellbore.

39. The method according to claim 27, wherein the sealingly engaging step further comprises setting a packer attached to the assembly in the second wellbore.

40. The method according to claim 27, wherein the sealingly engaging step further comprises cementing the assembly within the second wellbore.

41. The method according to claim 27, further comprising the step of providing a fluid passage through a whipstock positioned in the first wellbore adjacent the wellbore junction.

42. The method according to claim 41, wherein the providing step comprises cutting through an inner core of the whipstock.

43. The method according to claim 42, wherein the cutting step is performed prior to the sealingly engaging step.

44. The method according to claim 41, wherein the providing step is performed by dissolving an inner core of the whipstock.

45. The method according to claim 44, wherein the dissolving step is performed prior to the sealingly engaging step.

46. The method according to claim 44, wherein the dissolving step is performed after the sealingly engaging step.

47. The method according to claim 44, wherein the dissolving step is performed by circulating a fluid through the assembly.

48. The method according to claim 44, wherein the dissolving step is performed by contacting the inner core with an acidic fluid.

49. The method according to claim 27, further comprising the step of opening a fluid passage through a whipstock positioned adjacent the wellbore junction.

50. The method according to claim 49, wherein the opening step is performed by retrieving a plug blocking fluid flow through the passage.

51. The method according to claim 49, wherein the opening step is performed by dispersing a plug structure blocking fluid flow through the passage.

52. The method according to claim 51, wherein the dispersing step is performed by providing contact between the plug structure and fluid in the well.

53. The method according to claim 52, wherein the providing step is performed by piercing a barrier member isolating the plug structure from contact with the fluid.

54. The method according to claim 51, further comprising the step of constructing the plug structure of a mixture of sand and salt.

55. The method according to claim 27, further comprising the step of positioning a screen portion of the assembly within the wellbore junction.

56. The method according to claim 55, further comprising the step of dissolving an inner core of a whipstock positioned adjacent the wellbore junction by circulating a fluid through the screen portion.

57. The method according to claim 27, further comprising the step of providing access to the first wellbore on each side of the wellbore junction by severing the tubular assembly in the second wellbore, releasing an anchoring device releasably securing the first opposite end of the tubular assembly in the first wellbore, and retrieving the tubular assembly from the first wellbore.

* * * * *